United States Patent [19]

Sebastiani

[11] 4,012,936

[45] Mar. 22, 1977

[54] METHOD AND DEVICE FOR BENDING PIPES

[75] Inventor: Enrico Sebastiani, Milan, Italy

[73] Assignee: Tag Vertrieb A.G., Zurich, Switzerland

[22] Filed: Dec. 17, 1975

[21] Appl. No.: 641,580

[30] Foreign Application Priority Data

Dec. 20, 1974 Italy ..... 30863/74

[52] U.S. Cl. ..... 72/369; 72/389; 72/411

[51] Int. Cl.[2] ..... B21D 7/06

[58] Field of Search ..... 72/308, 369, 380, 381, 72/382, 383, 389, 394, 396, 411

[56] References Cited

UNITED STATES PATENTS 3,328,996 7/1967 Pin et al. ..... 72/369

FOREIGN PATENTS OR APPLICATIONS 624,227 5/1949 United Kingdom ..... 72/369

*Primary Examiner*—Lowell A. Larson
*Attorney, Agent, or Firm*—Wenderoth, Lind & Ponack

[57] ABSTRACT

A method and apparatus for bending tubular bodies, wherein elemental tubular sections are gradually shifted with respect to each other, without rotation, in a V-shaped bend from a central bend section. The apparatus includes two slidingly fitted supports for housing the tubular body to be bent, and a central triangular presser acting between the supports on the central tube section. The supports are gradually moved by the presser in opposite directions to define the tube sections that are actually shifted.

4 Claims, 15 Drawing Figures

Fig.1
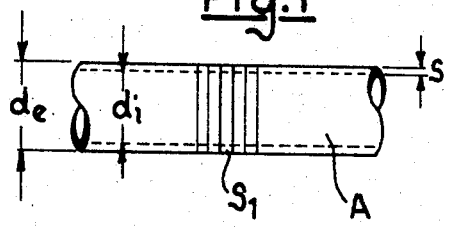
Fig.2
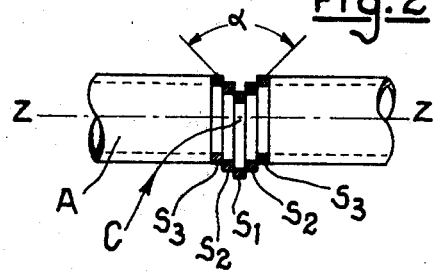
Fig.3
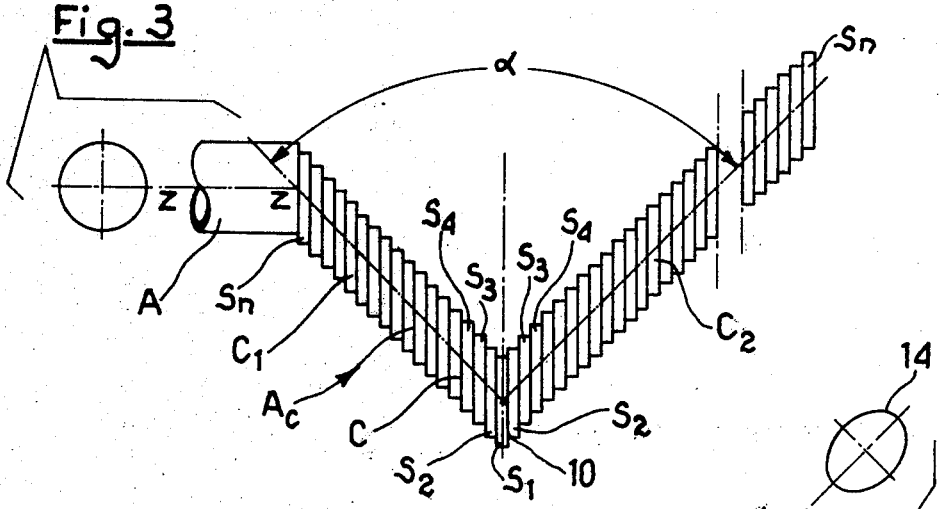
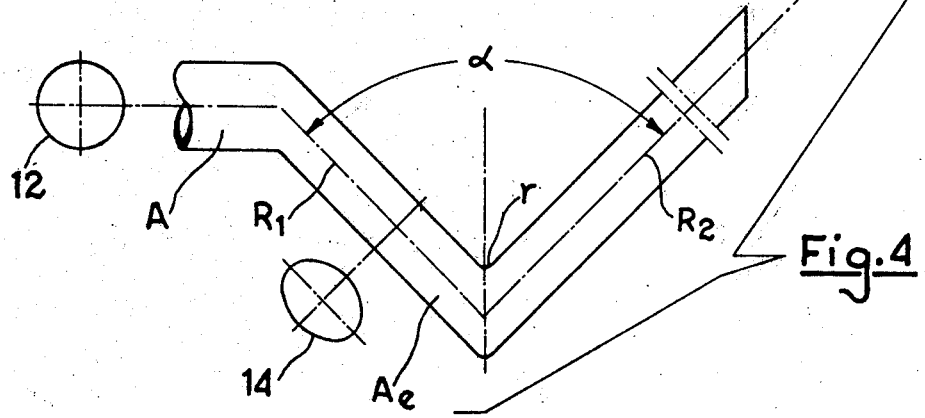
Fig.4
Fig.5
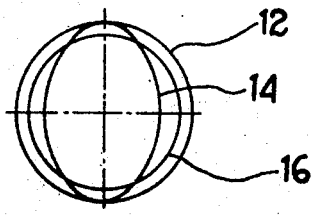

Fig. 6
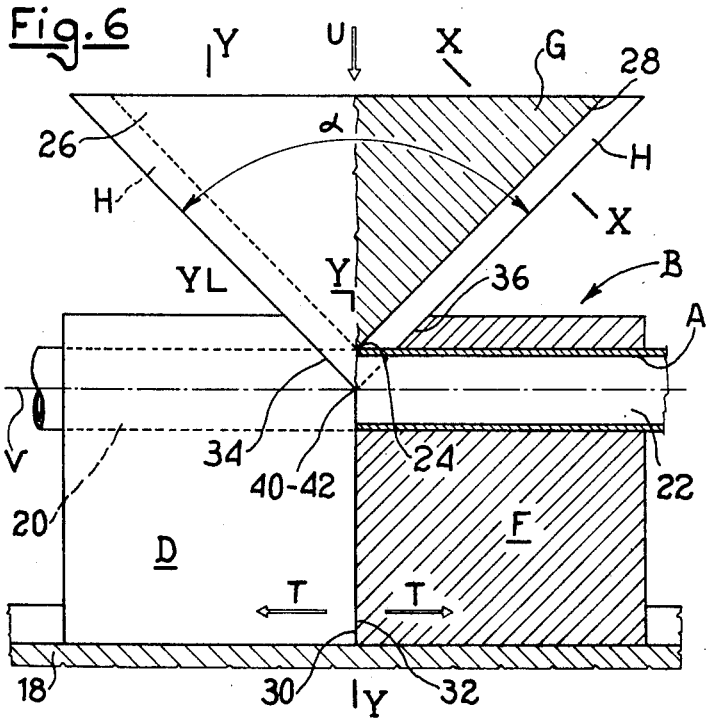
Fig. 8
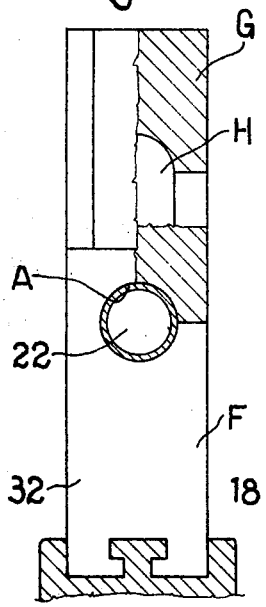
Fig. 7
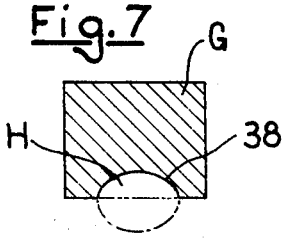
Fig. 9
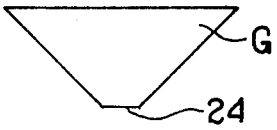
Fig. 10
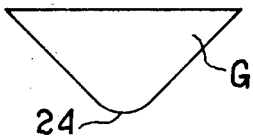
Fig. 11
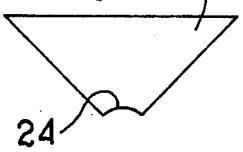
Fig. 12
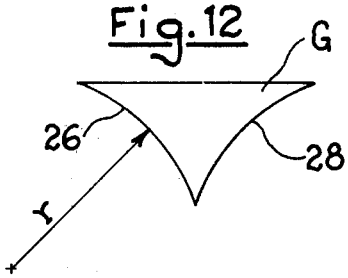
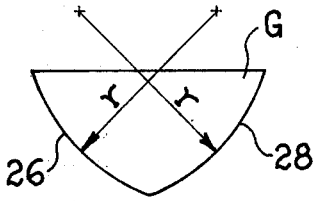
Fig. 13
Fig. 14
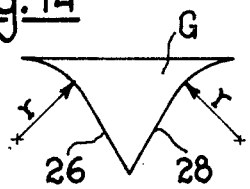
Fig. 15
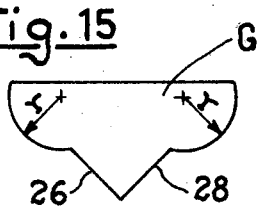

METHOD AND DEVICE FOR BENDING PIPES

BACKGROUND OF THE INVENTION

1. Field of the Invention

This invention relates to a method for bending tubular bodies or pipes as well as to a device or equipment for carrying out such method.

2. Description of the Prior Art

As is already well known, when forming pipe-lines for conveying fluids through tubular bodies, the pattern thereof is usually bent, since already existing and non removable obstacles and obstructions must be avoided (e.g. when conveying natural gas the pipe-lines must avoid houses, roads, rivers, various structures and the like, while in machine tools, the obstacles represented by control members, traverse runs of movable components and so on must be avoided).

Thus, the path of tubular bodies or pipes by which fluids are conveyed consists of a series of broken lines and includes elbows having preestablished radii curvature radii. Elbows having a very small radius of curvature cannot be obtained by pipe deformation and consequently when such small radius elbows are required, cast hollow bodies, which can have even a zero radius of curvature or welded elbows as obtained by hot forming an initially straight pipe with a minimum radius of curvature having the same order of magnitude as the pipe radius are to be used. Only for larger radii of curvature it is possible to obtain elbows by cold forming the same pipe as utilized for the pipelines.

These limits of the cold bending procedures are due to the working principle inherent in same procedures, since:

1. Only the pipe portion of the elbow is deformed.
2. The forming operation is carried out by mutual rotation of adjacent sections of the pipe length which is bent.

In all already known cold bending procedures, the minimum radius of curvature is a function both of the cross section of pipe to be bent (a function of the diameter in the case of cylindrical pipes), and of the pipe wall thickness, as well as of the material ductility or the ultimate elongation.

In fact, during the bending operation, wherein a mutual rotation of the deformed pipe sections occurs, all points of the outer side of the elbow are drawn away from each other as a consequence of stretching the pipe material, while all points of the inner side of the elbow are brought nearer to each other by compression, until eventually curling of the material is caused. When the pipe material to be stretched cannot be supported by a core, flattening of the pipe may take place, while curling occurs when the material of the inner side of the elbow cannot be kept stretched.

SUMMARY OF THE INVENTION

Accordingly, a method for cold bending metal tubular bodies, and in particular metal pipes as required forming fluid conveying pipelines is provided according to this invention in order to avoid the above and further drawbacks.

The present method is characterized in that the pipe portion to be bent or the whole pipe is submitted to a forming operation including a relatively low amount of work, and which is applied to the pipe portion to be bent in such a manner that adjacent portions thereof are compelled to move in parallel relation with each other, without turning in order to obtain at the end of the forming operation a bent pipe having a uniform cross section all along its path and a practically nil inside radius of curvature independently from the starting pipe section, the pipe wall thickness and the pipe material ductility.

Obviously, the thus defined invention may lead to different embodiments and applications, on the basis of the shape and structure of pipes to be bent, as well as of the means to carry out the method.

According to an advantageous embodiment, such means include a forming apparatus comprising a pair of supports, slidingly fitted on suitable guides and having aligned complemental seats, wherein the pipe to be bent can be housed, as well as a presser or pusher having a substantially triangular shape, and located above the pair of supports in such a manner that its pressure apex can be directed downwardly, i.e. toward the pipe to be bent, the presser being controllably and downwardly moved against the supports and the pipe, in such a manner as to exert a forming operation firstly on the pipe central portion directly below the pressure apex, and then on the adjacent further pipe portions on both sides of the central portion, as the supports are gradually drawn away from each other by the downwardly forced presser to leave bare such further portions of the pipe to be bent.

BRIEF DESCRIPTION OF THE DRAWINGS

The above and further features of the invention will be apparent from the consideration of the accompanying drawings, in which:

FIG. 1 is a side view of a straight metal pipe length, before a cold bending operation according to the method of this invention.

FIG. 2 is a view similar to that of FIG. 1 and theoretically showing the forming step of a portion of the pipe length.

FIG. 3 is a view similar to that of FIG. 2 and showing, also theoretically, a pipe length bent according to the method of this invention.

FIG. 4 is a front view showing the actual shape of the same pipe length of FIG. 3 after the bending operation.

FIG. 5 is a diagrammatic view of the pipe cross-sections, before and after the bending operation.

FIG. 6 is a partially sectional side view of a preferred apparatus for carrying out the method of this invention.

FIG. 7 is a cross-section of the apparatus, as taken along the line X—X of FIG. 6.

FIG. 8 is a cross-section of the same apparatus, as taken along the broken line Y—Y of FIG. 6.

FIGS. 9, 10 and 11 show additional possible shapes of the apex of the presser member.

FIGS. 12, 13, 14 and 15 show additional possible shapes of the operating sides of the presser member.

DESCRIPTION OF THE PREFERRED EMBODIMENTS

Referring now to the drawings and firstly to FIGS. 1 and 2 thereof, a length of cylindrical metal pipe A has an outer diameter $d_e$, an inner diameter $d_1$ and a wall thickness $s$ and is made of a suitable material, e.g. steel. Pipes having any diameter and wall thickness may be used, since the method of this invention can be applied independently from such dimensional values.

Assuming that the pipe length A is to be bent in a given way, e.g. as required by the pattern conditions of a pipeline including pipe A, the bend can be defined by a nil inner radius and by an angle alfa.

According to the method of this invention, a portion of pipe length A, or the whole pipe length, is submitted to a forming operation involving a relatively low amount of work and which results in successive displacements of pipe sections adjacent to the pipe portion to be bent, such sections being displaced in parallel relation with each other without any mutual rotation.

In the illustrated case, the forming work is firstly applied to the tubular cylindric section S1, which is thereby shifted downwardly by a given amount, but which maintains its original shape. The same operation is then simultaneously applied to both sections S2 adjacent to central section S1, which sections also shift downwardly by a given amount, thus moving central section S1 downwardly by the same amount. The sections S3, adjacent to the shifted sections S2, will remain in their places, since no work is exerted thereon.

The sections S1 and S2 are shifted in parallel relationship with each other and perpendicularly to the pipe length axis Z—Z, without any mutual rotation thereof, whereby a bend C having a required opening angle $\alpha$ is formed by linearly shifting such sections. In the previously considered case, the shifting of pipe length sections has been limited to the three sections only by way of example, as a plurality of sections forming a part of or even the entire pipe length are usually shifted.

Thus, by shifting the pipe sections in parallel relationship with each other, a bent pipe is obtained having a constant cross-section and a practically nil inner radius of curvature.

FIGS. 3 and 4 show the structure of a metal cylindrical pipe A, after a plurality of adjacent sections thereof have been submitted to a forming operation according to this invention, in order to shift the sections in parallel relationship with each other, and perpendicularly to the original pipe axis Z—Z. The structure of the bent portion $A_e$ as shown in FIG. 3 is a theoretical one, to better show how the shifting of adjacent pipe sections takes place, while the structure $A_e$ of FIG. 4 is that actually taken by the bent pipe.

The angle $\alpha$ of curve C is approximately 90° in the illustrated case, due to the perpendicular relationship of the two curve branches C1, C2 that intersect at the apex 10, while the inner radius of curvature $r$ is nil.

The single sections that are shifted in parallel relationship with each other are shown, starting from the central section S1, by the references S2, S3, S4 . . . $S_n$.

The inner free section of bent pipe $A_e$ is that perpendicular to the axes R1 and R2 and has an elliptical shape (section 14) since no change occurs in the shape of circular sections shifted in parallel relationship with each other.

When circular sections are required (for threadings or the like), the bent pipe length can be pressed in a direction perpendicular to the plane as defined by the axes R1 and R2. After such operation, the pipe section in a plane perpendicular to the axes R1, R2, will be converted into a circular section 16, having a reduced diameter with respect to that of the starting circular section 12 (FIG. 5).

The above obviously occurs for cylindrical pipes only, since the use of noncylindrical tubular bodies will always produce an altered section shape, but without attaining an elliptical configuration.

When using a cylindrical pipe, the final diameter $d$ of the bent pipe can be obtained from the following equation:

$$d\ \text{final} = \sqrt{\frac{\left(\cos\frac{\alpha}{2}\cdot\frac{d\ \text{starting}}{2}\right)^2 + \frac{d^2\ \text{starting}}{4}}{2}}$$

Accordingly, the starting pipe diameter can be easily obtained from the required final diameter of the bent pipe.

In an embodiment of the bending method according to this invention, the compression of the bent pipe in order to bring the cross-sectional configuration of the shifted sections back to their original shape (e.g. to bring the elliptical configuration back to a circular configuration) is applied to the pipe during the original forming or bending operation, that is simultaneously with the application of the initial forming work. Thus, at the end of the bending operation, all pipe sections perpendicular to axes R1 and R2, will retain their circular configuration, instead of taking the elliptical configuration shown in the drawings.

Referring now to FIGS. 6 to 8, an apparatus B adapted to bend a metal pipe length by parallelly shifting adjacent sections thereof, comprises a pair of supports D and F, slidingly fitted on suitable guides 18 and defining seats 20 and 22 aligned on a common axis V to house a pipe A to be bent. A substantially triangularly shaped presser or pusher G is located above the pair of supports, and is designed to cooperate therewith, in such a manner that its pressure apex 24 be directed downwardly, i.e. toward the pipe A to be bent. Presser G has a groove H extending along both sides 26, 28 of the triangle thereof and across the apex 24 thereof. Sides sides 26, 28 are perpendicular with each other to define an apex angle of 90° corresponding to the desired angle between the pipe curve branches. The upper portions of the facing vertical planes 30 and 32 of supports D and F are tapered at 45° in order to form inclined planes 34, 36 adapted to cooperate with the related sides of presser or pusher G when the apparatus is operated.

The operation of apparatus B is as follows: a pipe length A is housed in the seats 20, 22 when the planes 30, 32 are kept into mutual contact and then the presser G is downwardly driven in the direction of arrow U, thereby exerting a given thrust onto the pipe A, such thrust being exerted also along the inclined planes 34, 36.

Pipe length A is then initially contacted by the apex 24 of presser G and its center section is downwardly shifted by a pre-established small amount. Then, due to a further downward motion of presser G, the supports D and F are caused to slide outwardly in the direction of arrows T on their guides 18, thereby gradually exposing further adjacent sections of the pipe length, which are similarly shifted downwardly. At the end of the downward stroke of presser G, and thus of the motion of supports D and F away from each other, the forming action exerted on pipe length A has caused a shifting of pipe sections as above described and thus the formation of a pipe elbow similar to that shown in FIGS. 3 and 4.

During the forming operation, the groove H exerts a pressure on the pipe length by means of its surface 38 that comes into contact with the pipe and acts as a settling and stabilization means for the pipe.

Owing to the structure of the described apparatus B, the forming work is instantaneously performed, while the presser G is moved downwardly on only those pipe sections which are below the corners 40, 42 formed by the intersection of plane 30 with the plane 34 and of plane 32 with the plane 36.

Thus, according to the above description method, elbows can be formed on straight tubular bodies, and such elbows will have a practically nil inner radius of curvature as well as a uniform wall thickness across the whole elbow length, along with uniform and constant pipe sections in directions perpendicular to the pipe branches.

A double elbow with a central connecting pipe length and a nil inner radius of curvature may be formed according to the invention, with the double elbow having a uniform and constant wall thickness and constant pipe sections in both outside branches and a larger section in the central connecting length.

Bends can also be formed on tubular bodies having any conformation and structure. Pipe coils having a constant or even enlarged section can also be obtained by the present bending procedure, with coils that might also include elbows formed by conventional procedures.

The shape of the operating profile of the presser may be changed according to the shape of the elbows that are to be formed. The apex 24 may be chamfered or rounded-off in different ways, e.g. as shown in FIGS. 9, 10 and 11. In such cases, the presser forms an intermediate junction wherefrom the elbow inclined branches extend.

The working sides 26, 28 of the presser may have different shapes as shown in FIGS. 12 to 15, and then the shapes of elbows thus formed would correspond to that of the presser working sides.

While the bending method is preferably a cold forming operation, it may also be a hot forming operation. Further, the method can be applied not only to metal pipes, but also to pipes made of other materials, e.g. plastic pipes.

The illustrated forming apparatus may be also associated with other equipment for the conventional bending of pipes, as obtained by the rotation of pipe sections.

While preferred embodiments of the invention have been herein shown and described, it is to be understood that various changes and modifications may be made without departing from the spirit and scope of this invention.

I claim:

1. A method for forming a bend having a substantially zero inner radius of curvature in a pipe, said method comprising:

providing a straight length of pipe having a longitudinal axis and a predetermined cross-sectional configuration transverse to said axis, said length of pipe having a portion longitudinally thereof to be deformed into a bend;

applying a force, in a direction transverse to said axis, to a first section of said portion to be deformed, and physically shifting said first section in said direction;

applying a force in said direction to second sections of said portion to be deformed on immediate opposite longitudinal sides of said first section, and physically shifting said second sections in said direction while further shifting said first section; and continuing to apply a force to successive additional sections of said portion to be deformed on opposite longitudinal sides of said first section, and successively physically shifting said additional sections in said direction while further shifting previously shifted sections;

all of said sections being shifted solely in said direction and parallel to each other;

whereby there is formed in said portion to be deformed a bend having a substantially zero inner radius of curvature.

2. A method as claimed in claim 1, whereby during said steps of shifting said sections the cross-sectional configuration thereof is altered from said predetermined cross-sectional configuration; and further comprising, after said bend is formed, applying a force to said sections of said bend in a direction transverse to the plane of said bend and compressing said sections to a configuration similar to but of a smaller dimension than said predetermined cross-sectional configuration.

3. An apparatus for forming a bend having a substantially zero inner radius of curvature in a pipe, said apparatus comprising:

a pair of tube supports slidably fitted on guides to be movable in longitudinal directions away from each other;

said supports having therein tube seat means for supporting a straight length of pipe in alignment with the directions of movement of said supports;

a generally triangular-shaped presser mounted for movement toward a pipe positioned in said seat means in a direction transverse to said directions of movement of said supports;

said presser having an apex comprising means to contact any physically shift in said transverse direction a first section of a pipe positioned in said seat means when said presser is moved toward said pipe; and said presser having opposite surfaces equally diverging away from said apex and comprising means to contact and physically shift in said transverse direction successive further sections on opposite longitudinal sides of said first section of said pipe when said presser is further moved toward said pipe, said supports being moved away from each other in said directions by movement of said presser in said transverse direction.

4. An apparatus as claimed in claim 3, wherein said apex and said opposite surfaces of said presser have therein a continuous groove of a shape similar to that of the pipe to be deformed.

* * * * *